US005678481A

United States Patent [19]

Matsumoto et al.

[11] Patent Number: 5,678,481

[45] Date of Patent: Oct. 21, 1997

[54] METHOD OF SCREEN PRINTING A PATTERN ON AN EDGE OF A GLASS SUBSTRATE

[75] Inventors: Akinori Matsumoto; Tatsuo Sugiyama, both of Aichi, Japan

[73] Assignee: Asahi Glass Company Ltd., Tokyo, Japan

[21] Appl. No.: 493,129

[22] Filed: Jun. 21, 1995

[30] Foreign Application Priority Data

Jun. 24, 1994 [JP] Japan ..... 6-143482

[51] Int. Cl.[6] ..... B41F 15/36; B41L 13/12; B41N 1/24

[52] U.S. Cl. ..... 101/129; 101/127

[58] Field of Search ..... 101/127, 128.21, 101/128.4, 129

[56] References Cited

U.S. PATENT DOCUMENTS

| | | | |
|---|---|---|---|
| 4,958,560 | 9/1990 | Collins | 101/129 |
| 5,240,816 | 8/1993 | Naguchi et al. | 101/129 |
| 5,390,595 | 2/1995 | Cutcher | 101/129 |
| 5,473,981 | 12/1995 | Mazaki | 101/129 |
| 5,593,080 | 1/1997 | Teshima et al. | 101/127 |

FOREIGN PATENT DOCUMENTS

| | | | |
|---|---|---|---|
| 0 281 351 | 9/1988 | European Pat. Off. . | |
| 82 049 | 7/1895 | Germany . | |
| 3231382 | 3/1984 | Germany | 101/128.4 |
| 43 11 002 | 6/1994 | Germany . | |
| 19039 | 4/1982 | Japan | 101/128.4 |
| 160198 | 9/1983 | Japan | 101/129 |
| 2 050 104 | 12/1980 | United Kingdom . | |
| 2 05 214 | 11/1981 | United Kingdom . | |

*Primary Examiner*—Stephen R. Funk

*Attorney, Agent, or Firm*—Oblon, Spivak, McClelland, Maier & Neustadt, P.C.

[57] ABSTRACT

A print pattern is formed on a glass plate 1 by using a screen plate in which a second ink-permeable region 7 having a lower ink-permeating rate than a first ink-permeable region 4 is formed in a screen region which corresponds to a space between the flat edge portion of the first ink-permeable region 4 and the outer end portion of the glass plate 1, whereby the formation of a locally raised portion in the film formed by printing at its end portion is avoided, and a decorative print is formed by a simple method without leaving a space in a flat end portion of the glass plate.

3 Claims, 3 Drawing Sheets

METHOD OF SCREEN PRINTING A PATTERN ON AN EDGE OF A GLASS SUBSTRATE

BACKGROUND OF THE INVENTION

1. Field of the Invention

The present invention relates to a method of forming a print pattern on a plate-like substrate and a screen plate used for the method.

2. Discussion of the Background

In some cases, decorative prints 2 are formed, as shown in FIG. 4, at an outer circumferential portion of glass sheets 1 such as window glass plates for automobiles by a screen printing method. In particular, when the glass sheets are window glass plates for automobiles, the decorative prints 2 constitute decorations when they are provided in window frames of automobiles, and serve to prevent the deterioration of materials for the window frame made of rubber, plastics or the like due to exposure to direct sunlight.

FIG. 5 shows schematically the shape in cross section of a film formed by a conventional screen printing method, and FIG. 7 is an enlarged diagram showing an end portion of the film. In a conventional printing method, the thickness of an end portion of the film was apt to be locally thickened in comparison with other portions.

In forming a decorative print on a laminated glass plate for an automobile, it is formed on a cabin side of an outer glass sheet of the laminated glass plate or on an exterior side of an inner glass sheet of the laminated glass plate. In manufacturing the laminated glass plate, a decorative print is usually formed either on an outer glass sheet or an inner glass sheet by a screen printing method. The glass sheet is subjected to a printing method and dried. Then, two glass sheets are overlapped. Beat is applied to the glass sheets to bend them. Since the decorative print is formed on the cabin side of the outer glass sheet or the exterior side of the inner glass sheet of the laminated glass plate, the decorative print is interposed between the overlapped glass sheets. In this case, when the decorative print has a locally raised portion, i.e., the film of the decorative print has a locally raised portion at its end portion, there occurs a problem that the two glass sheets are in mutual contact at the raised portion in the heating and bending process, or a print pattern at the raised portion is transferred to the other glass sheet.

On the other hand, in forming a decorative print on a glass plate such as a window glass plate for an automobile, it is desirable to form the decorative print at a correct position so as to extend to a flat end portion of the glass plate as shown in FIG. 5. A print pattern region can be formed precisely in a screen used for printing by using a photoengraving process or the like. However, when glass plates are cut or chamfered, it is sometimes insufficient to obtain accurate dimensions, and there may cause dispersion of several mm depending on the size of glass plates. As a result, correct printing patterns may not be able to form at correct regions when printing is to be formed on a number of glass plates.

Accordingly, when a print pattern is to be correctly formed on glass plates so that it reaches their flat end portions a, it is necessary to match the print pattern region of the screen with the size of the glass plate. However, a space 6 is produced between the decorative pattern 5 and a flat end portion a of the glass plate as shown in FIG. 5 because of dispersion in the size of the glass plate or a location of the glass plate to be placed under the screen plate.

When the print pattern of the screen is enlarged so as not to produce the space 6, there is a case that the end portion of the print pattern region 4 is beyond the flat end portion a of the glass plate 1 as shown in FIG. 6. When printing is repeated under such condition, ink 5 drips from an edge b of the glass plate whereby portions other than the surface of the glass plate e.g., a support table for the glass plate, a non-printed region of the glass plate, a print machine and so on are stained thereby inviting difficulty in series production.

As a method of eliminating the above-mentioned problem, there is such a method wherein the print pattern region of the screen is formed to have a smaller size than the outer periphery of the glass plate. In this case, however, as shown in FIG. 4, a space or spaces 6 are produced at a circumferential portion or portions of the print pattern 2, which deteriorates good appearance.

In order to solve the above-mentioned problem, Japanese Unexamined Patent Publication No. 279382/1992 proposes a method of printing several times. However, the method has problems that two or more times of printing are required to a single glass plate, and it is difficult to match print patterns formed by several times of printing.

Japanese Unexamined Patent Publication No. 70164/1993 proposes that oversize printing be conducted to a glass plate, and thereafter, the glass plate is cut to have a predetermined region of printing.

Further, Japanese Unexamined Patent Publication No. 70179/1993 proposes a technique that a paper is disposed adjacent to the outer periphery of a glass plate; oversize printing is conducted, and then, the paper is separated from the glass plate. In these methods, the number of manufacturing steps is increased and the processes become complicated.

It is an object of the present invention to provide a method of forming a print pattern on a plate-like substrate whereby there is no risk of producing a locally thickened portion at an end portion of a printed film.

Further, it is an object of the present invention to provide a method of forming a print pattern on a plate-like substrate which allows to form a decoration without leaving a space at a flat end portion of the plate-like substrate.

SUMMARY OF THE INVENTION

In accordance with the present invention, there is provided a method of forming a print pattern on a peripheral portion of a plate-like substrate by a screen printing method, characterized in that printing is conducted by using a screen plate having a first ink-permeable region and a second ink-permeable region which is provided at an outer side adjacent to the first ink-permeable region wherein the second ink-permeable region has a lower ink-permeable rate than the first ink-permeable region at a portion adjacent to the second ink-permeable region.

In accordance with the present invention, the second ink-permeable region is to limit ink to pass therethrough so that the ink passed through the second ink-permeable region is transferred onto the plate-like substrate without forming a locally raised portion whereby a mat-like, i.e., completely filled area having no locally raised portions, state of printing is provided.

In accordance with the present invention, the screen plate is so formed that the outer edge portion of the first ink-permeable region corresponds to a portion inside of the flat end portion of the substrate, and the second ink-permeable region is formed at a portion corresponding to a space between the outer edge portion of the first ink-permeable region and the outer edge portion of the substrate.

Further, in accordance with the present invention, there is provided a screen plate for forming a print pattern on a peripheral portion of a plate-like substrate by a screen printing method, which comprises a first ink-permeable region and a second ink-permeable region which is provided at an outer side adjacent to the first ink-permeable region, the first and second ink-permeable regions corresponding to the peripheral portion of the plate-like substrate, wherein the second ink-permeable region has a lower ink-permeable rate than the first ink-permeable region at a portion adjacent to the second ink-permeable region.

The first ink-permeable region is formed to have a mesh like pattern or another suitable pattern which has been used in conventional techniques, and is not limited in particular. However, it is preferable to have the same mesh-like pattern as that formed in the second ink-permeable region. Further, the first ink-permeable region may be formed to have a mat-like pattern or any pattern having various types of shape which have been conventionally known.

The second ink-permeable region in the present invention may be formed to have a fine dot-like pattern, a fine line pattern, a fine net-like pattern wherein a plurality of lines are crossed, or the like. In particular, the fine dot-like pattern is most preferable because a good result can be obtained. For instance, a gradation pattern wherein an ink-permeable rate is gradually reduced from the inside of the glass plate to the outside of it, may be used. In particular, it is necessary to limit an amount of ink passing through the second ink-permeable region so that ink to be transferred onto the plate-like substrate flows without forming a locally raised portion and provides a mat-like printed state. For this purpose, it should have a fine pattern of a dot type, a line type or a net type.

In the construction of the second ink-permeable region of the present invention, it should not be limited in particular. It is appropriate that the mesh size of the screen plate is 90–380, preferably 120–250. When a dot-like pattern is used, it is proper that the number of lines (the number of dots per 1 inch) is 60–360, and the density (the percentage of the ink-permeable region in a unit surface area) is 50–98%.

Under the conditions of a mesh size of 160, a number lines of 120–150 and a density of 80–90%, in particular, there are obtainable a remarkable effect of limiting an amount of ink passing through the second ink-permeable region, and of printing without forming a locally raised portion at an edge portion while reducing the film thickness in the overall portion and without leaving a fault such as pin holes in a decorative print area.

The method of the present invention can be applied to various types of substrate such as a glass substrate, a ceramic substrate, a plastic substrate and so on. In particular, the present invention can be effectively applied to a flat window glass of various sizes for an automobile. However, it may also be applied to a glass plate used for other vehicles, buildings, electric appliances, furnitures and so on.

There is no limitation on the shape or the condition of the edge surface of the substrate. The screen printing method used for the present invention may be conducted by using a well-known screen printing device. Further, besides the screen printing method, a stencil process or a photoengraving process may be used.

As the ink used for the present invention, screen ink of an oil type or a water type may be used. As the kinds of the ink, ink of a normal dry type, a catalytic curing type, a baking type, a frit-containing ink exclusive use for glass or the like may be used.

DESCRIPTION OF THE PREFERRED EMBODIMENTS

Figure 1:
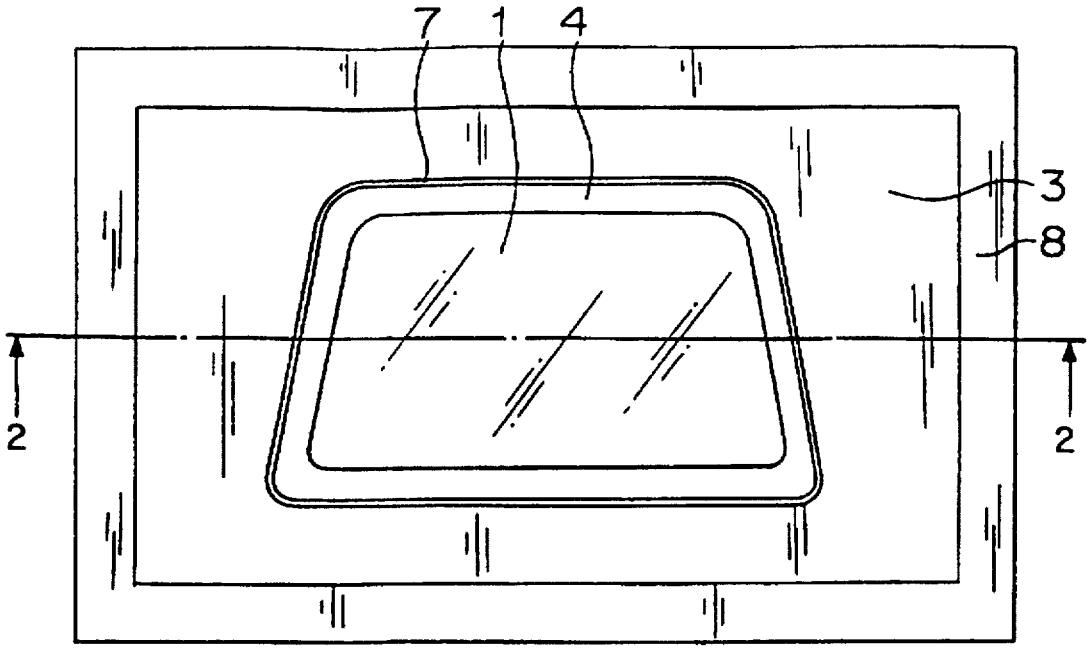
FIG. 1 is a plan view showing an embodiment of the method of the present invention.

Preferred embodiment of the present invention will be described with reference to the drawings wherein the same reference numerals designate the same or corresponding parts.

Figure 7:
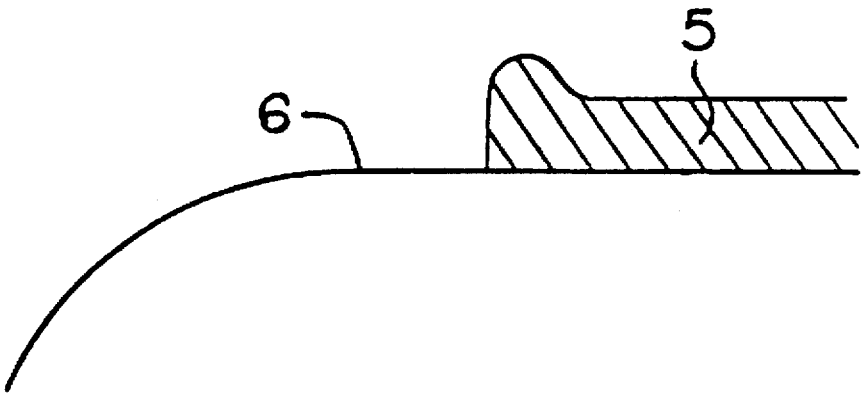
FIGURE 7 PRIOR ART
FIG. 7 is an enlarged view of a part of FIG. 5.
Figure 8:
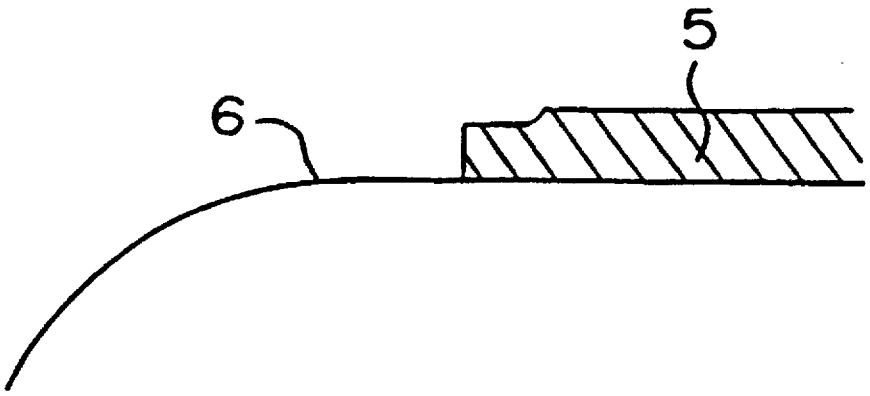
FIG. 8 is an enlarged diagram explaining function according to the present invention.

A state of a print pattern formed according to the method of the present invention is shown in FIG. 8 in correspondence to FIG. 7 which shows a state of a print pattern formed by a conventional technique.

In the present invention, a screen plate having a second ink-permeable region is used. Accordingly, an amount of ink supplied through the second ink-permeable region is small. Therefore, as shown in FIG. 8 which shows the shape of a film formed by printing in cross section, a locally raised portion is not found at an edge portion of the film in comparison with another portion. Accordingly, when a laminated glass plate is manufactured by heating and bending two overlapped glass sheets, mutual contact of the glass sheets which constitute the laminate glass and the transfer of a print pattern formed on one of the glass sheets to the other can be prevented.

In the present invention, printing is conducted by using the screen plate which has a first ink-permeable region which is smaller than the size of the outer periphery of a glass plate to be printed and the second ink-permeable region which is provided at a region corresponding to a space between the outer edge portion of the first ink-permeable region and the outer edge portion of the glass plate so as to be adjacent to the outer circumference of the first ink-permeable region. Accordingly, a decoration can be formed on the outer end portion of the glass plate without leaving any space.

The second ink-permeable region has a fine pattern. Accordingly, in a printed portion, any pattern disappears on the printed region corresponding to the second ink-permeable region due to the fluidity of the ink after a printing process or during a baking process, and a mat-like state of print is provided. Therefore, a pin hole or pin holes do not take place in the decorative print formed on the glass plate.

In the present invention, since the screen plate having the second ink-permeable region is used, an amount of ink passing through the second ink-permeable region at a portion near the flat end portion of the glass plate is restricted. As a result, even though there is dispersion in the size of the glass plate, or inaccuracy of position of the glass plate, an amount of ink to be supplied to the flat end portion or the outside of the flat end portion of the glass plate is small.

Accordingly, a big problem is not caused even though there takes place leakage of ink from the screen.

The second ink-permeable region provided at a position corresponding to a flat end portion of the glass plate prevents the ink from dripping which takes place in a case that the ink-permeable region of the screen is beyond the glass plate. Further, the second ink-permeable region eliminates a problem of reducing the quality of the appearance of the decorative print on the glass plate after the printing.

FIG. 1 is a diagram showing an embodiment of the present invention. A first ink-permeable region 4 having a shape similar to the shape of a glass plate 1 and a size smaller than that of the glass plate 1 is formed in a screen 3 surrounded by a frame 8. A second ink-permeable region 7 is formed in the screen 3 at the outside of and along the outer periphery of the first ink-permeable region wherein the second ink-permeable region 7 is to limit an amount of ink to be passed through the region 7.

Figure 2:
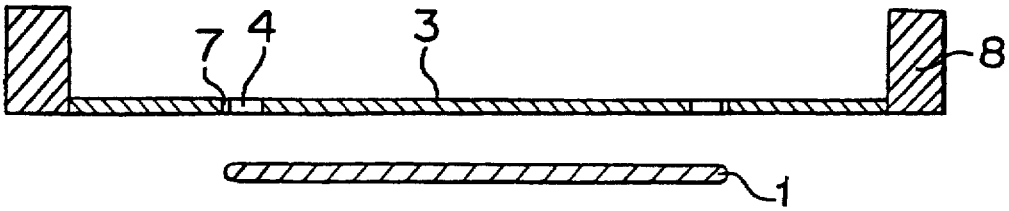
FIG. 2 is a cross-sectional view taken along a line A—A in FIG. 1.

In FIGS. 1 and 2, the second ink-permeable region 7 is formed in the entire portion of the outer periphery of the glass plate. However, it may be formed in only a portion corresponding to an arbitrary portion of the glass plate 1.

Figure 3:
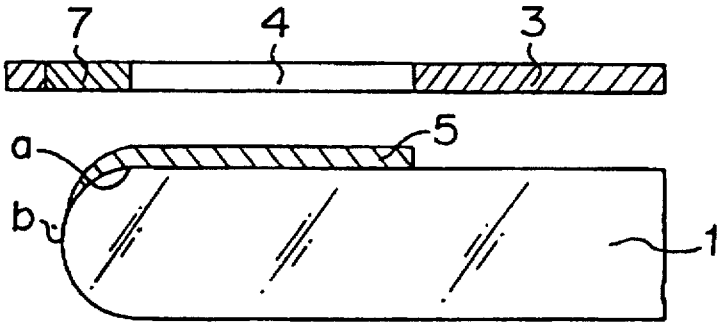
FIG. 3 is an enlarged view of a part of FIG. 2.
Figure 4:
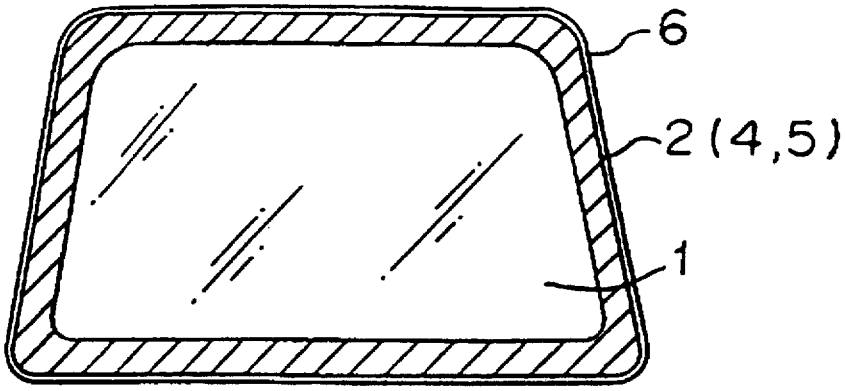
FIGURE 4 PRIOR ART
FIG. 4 is a diagram explaining a conventional technique.
Figure 5:
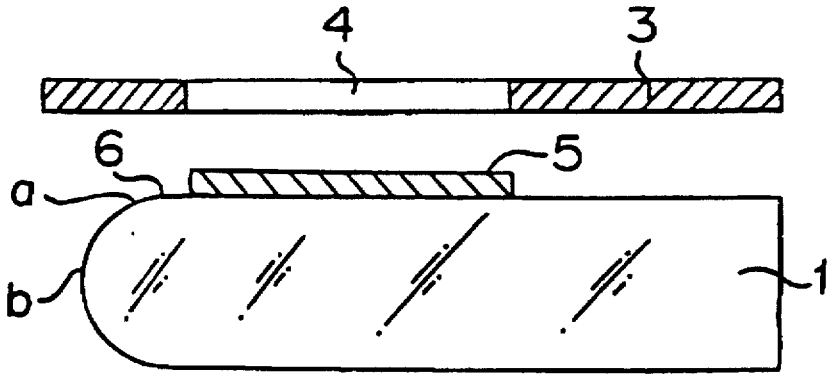
FIGURE 5 PRIOR ART
FIG. 5 is a diagram explaining another conventional technique.
Figure 6:
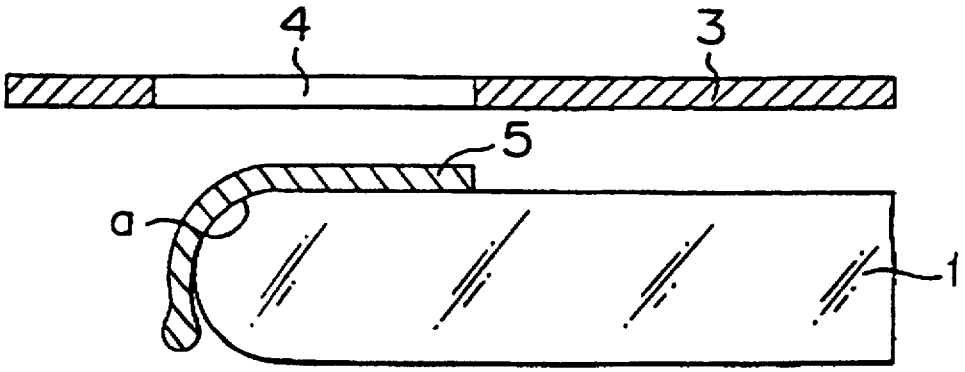
FIGURE 6 PRIOR ART
FIG. 6 is a diagram showing another conventional technique.

FIG. 2 is a cross-sectional view taken along a line A—A in FIG. 1, and FIG. 3 is an enlarged view of a part of FIG. 2. The outer edge portion of the first ink-permeable region 4 formed in the screen 3 should be inside the outer edge portion b of the glass plate 1. Since the second ink-permeable region is formed adjacent to the outer periphery of the first ink-permeable region 4, the formation of a locally raised portion which is produced at its end portion in the printed film can be avoided.

When a decorative print is to be formed without leaving a space at the flat end portion a of the substrate, the outer edge portion of the first ink-permeable region 4 should be in coincidence with the position of the flat end portion a of the glass plate 1, or should be more or less inside of it. Further, the outer edge portion of the second ink-permeable region 7 should be substantially in coincidence with the position of the edge portion b of the glass plate 1. In this case, the outer edge portion of the second ink-permeable region 7 may be more or less inside or outside of the edge portion b.

Screen printing is conducted under such conditions. Then, a print pattern 5 is formed inside of the outer edge portion b of the glass plate 1. Accordingly, there is no risk of dripping of ink 5 from the outer edge portion b of the glass plate 1 though a slight amount of the ink flows to the outer edge portion b due to its gravity.

An amount of the ink passing through the second ink-permeable region 7 is small. Accordingly, there is no problem even when the ink remains on the back surface of the screen plate without being transferred to the glass plate 1.

Since there is dispersion in the size of glass plates, or the glass plates may not be positioned at a correct position in printing operations, the second ink-permeable region 7 may sometimes be beyond the outer edge portion b of the glass plates. Even in this case, however, since an amount of the ink passed through the extended portion of the second ink-permeable region 7 is small, the ink does not drip from the screen 3, whereby there is no risk of dripping of the ink onto a supporting table (not shown) for the glass plate 1, or flowing around the outer edge portion of the glass plate to reach the back surface of the glass plate 1 thereby staining it.

The second ink-permeable region 7 may be so formed that an amount of ink permeating through that region 7 is gradually reduced from its inner side to the outer side. With such a structure, a dot pattern is formed at a position near the flat end portion b of the glass plate 1 wherein a greater amount of ink is permeated through the second ink-permeable region 7 whereas a dot pattern is formed at a position near the outer edge portion b of the glass plate 1 wherein a smaller amount of ink is permeated through that region 7. However, since the ink has a certain fluidity, dots of ink are unified with the lapse of time and a uniform mat-like state of print is provided whereby an excellent appearance of printed pattern is obtainable. Further, when the printed ink is baked after printing, the ink is softened to flow at a baking temperature so that a uniform decorative pattern is formed (FIG. 3).

EXAMPLE 1

A 160 mesh screen plate was used. A second ink-permeable region of a width of 2 mm having a low ink permeable rate (which had 85 lines and a density of 80%) was formed at a circumferential portion of the screen plate. The screen plate and a window glass (a glass plate) for automobile were disposed so that the boundary between a first ink-permeable region and the second ink-permeable region (hereinbelow referred to simply as the boundary) was disposed at a position 1 mm inside the flat end portion of the glass plate. Printing was conducted with use of a heat transfer type black screen ink. The first ink-permeable region near the boundary had a mat-like pattern and the second ink-permeable region had a dot-like pattern.

As a result, a print pattern was formed in the peripheral portion of the glass plate without leaving any space. It was found that the thickness of the film formed by printing through the first ink-permeable region at a position near the boundary was 20 μm and the thickness of the film formed by printing through the second ink-permeable region was 16 μm with the result that there was obtainable 20% reduction of ink permeating quantity.

In forming a decorative print continuously on 100 sheets of window glass for automobile by using a single screen plate and the above-mentioned method, there was no problem of dripping of ink.

EXAMPLE 2

Printing was conducted in the same manner as Example 1 by using the same screen plate except that the number of lines and the density of the second ink-permeable region were 160 and 90% respectively.

As a result, a print pattern was formed in the circumferential portion of glass plates without leaving any space. It was found that the thickness of the film formed by printing through the first ink-permeable region at a position near the boundary was 21 μm, and the thickness of the film formed by printing through the second ink-permeable region was 17 μm with the result that there was obtainable 19% reduction of ink permeating quantity.

A decorative print was formed continuously on 100 sheets of window glass for automobile by using a single screen in the same manner as example 1. As a result, a problem of the dripping of the ink did not take place.

EXAMPLE 3

A print pattern was formed in the same manner as Example 1 by using the same screen plate except that the number of lines and the density of the second ink-permeable region were respectively 140 and 83%. As a result, a print pattern was formed in the circumferential portion of the glass plates without leaving any space. It was found that the thickness of the film formed by printing through the first ink-permeable region at a position near the boundary was 20 μm and the thickness of the film formed by printing through the second ink-permeable region was 14 μm with the result that there was obtainable 30% reduction of ink permeating quantity.

A decorative print was formed continuously on 300 sheets of window glass for automobile by using a single screen plate in the same manner as Example 1. As a result, a problem of the dripping of the ink did not take place.

Then, two glass plates were overlapped interposing the printed film therebetween, and the overlapped glass plates were heated at a temperature higher than a glass softening point. However, mutual contact of the glass plates and the transfer of ink from one glass plate to the other did not take place.

EXAMPLE 4

A print pattern was formed in the same manner as Example 3 except that a screen plate without having the second ink-permeable region was used. As a result, the circumferential portion of the glass plates had a space where no print pattern was formed. Further, the thickness of the printed film at its end portion was 25 μm and the thickness of the film at other portions was 20 μm.

In the same manner as Example 3, two glass plates were overlapped interposing the printed film therebetween, and the two glass plates were heated at a temperature higher than a glass softening point. As a result, the mutual contact of the two glass plates occurred at an end portion of the printed film.

EXAMPLE 5

A print pattern was formed in the same manner as Example 3 except that a screen plate in which the second ink-permeable region was omitted and the first ink-permeable region was extended to the area of the second ink-permeable region was used. As a result, the circumferential portion of the glass plates had no space where no print pattern was formed. However, when a decorative print was formed continuously on a glass plate for an automobile by using a single screen plate, dripping of the ink took place after the printing operations were conducted for three glass plates.

In accordance with the present invention, the formation of a locally raised portion at an end portion of the film formed by printing on a plate-like substrate can be avoided. Accordingly, for instance, in manufacturing laminated glass, even when two overlapping glass plates interposing a decorative print therebetween are heated for bending, the mutual contact due to the decorative print between the overlapping glass plates and the transfer of the print pattern to the other glass plate can be prevented.

Further, a decorative print can be formed on a glass plate such as window glass even in its flat end portion by using a single method without a large plant investment. In addition, the dripping of the ink from the back surface of the screen plate rarely occurs, and a wiping operation for the back surface of the screen plate can be minimized or omitted even in continuous printing operations.

We claim:

1. A method of forming a print pattern on a peripheral portion of a window glass for an automobile, by a screen printing method, wherein printing is conducted by using a screen plate having a first ink-permeable region and a second ink-permeable region formed to have a fine dot pattern, a fine line pattern or a fine net pattern wherein a plurality of lines are crossed, adjacent to the first ink-permeable region at an outer side thereof, wherein the second ink-permeable region has a lower ink-permeable rate than the first ink-permeable region at a portion of the first ink-permeable region adjacent to the second ink-permeable region.

2. A method of forming a print pattern according to claim 1, comprising passing ink through the second ink-permeable region onto the window glass in amounts to provide a completely filled area with no locally raised portions.

3. A method of forming a print pattern according to claim 1, wherein the screen plate is so formed that the outer side of the first ink-permeable region corresponds to a portion inside of a flat end portion of the substrate, and the second ink-permeable region is formed at a portion corresponding to a space between the outer side of the first ink-permeable region and an outer edge portion of the substrate.

* * * * *